US008988329B2

(12) United States Patent
Yoon et al.

(10) Patent No.: US 8,988,329 B2
(45) Date of Patent: Mar. 24, 2015

(54) ORGANIC LIGHT EMITTING DIODE DISPLAY DEVICE AND METHOD FOR SENSING CHARACTERISTIC PARAMETERS OF PIXEL DRIVING CIRCUITS

(71) Applicant: LG Display Co., Ltd., Seoul (KR)

(72) Inventors: Joong-Sun Yoon, Paju-si (KR); Seung-Tae Kim, Goyang-si (KR); Ji-Hyun Kang, Daegu (KR); Ji-Eun Lee, Seoul (KR)

(73) Assignee: LG Display Co., Ltd., Seoul (KR)

( * ) Notice: Subject to any disclaimer, the term of this patent is extended or adjusted under 35 U.S.C. 154(b) by 105 days.

(21) Appl. No.: 13/715,080

(22) Filed: Dec. 14, 2012

(65) Prior Publication Data

US 2013/0162617 A1 Jun. 27, 2013

(30) Foreign Application Priority Data

Dec. 26, 2011 (KR) ..... 10-2011-0142040

(51) Int. Cl.
*G09G 3/30* (2006.01)
*G09G 3/32* (2006.01)

(52) U.S. Cl.
CPC ..... *G09G 3/3291* (2013.01); *G09G 3/3233* (2013.01); *G09G 2300/0861* (2013.01); *G09G 2320/0295* (2013.01)
USPC ..... 345/77; 345/211

(58) Field of Classification Search
CPC ..... G09G 3/32; G09G 3/3208; G09G 3/3225–3/3291; G09G 2320/0233; G09G 2320/043–2320/048; G09G 2320/029; G09G 2320/06
USPC ..... 345/76–83, 204, 690
See application file for complete search history.

(56) References Cited

U.S. PATENT DOCUMENTS

2008/0252568 A1 10/2008 Kwon
2010/0103082 A1 4/2010 Levey et al.

(Continued)

FOREIGN PATENT DOCUMENTS

CN 101281705 A 10/2008
CN 101345022 A 1/2009

(Continued)

OTHER PUBLICATIONS

Korean Intellectual Property Office, Office Action, Korean Patent Application No. 10-2011-0142040, Mar. 14, 2014, five pages [with concise explanation of relevance in English].

(Continued)

*Primary Examiner* — Stephen Sherman
(74) *Attorney, Agent, or Firm* — Fenwick & West LLP

(57) ABSTRACT

Disclosed are an OLED display device and method for sensing characteristic parameters of pixel driving circuits. The display device includes a display panel including pixels each having a light emitting element and a pixel driving circuit for independently driving the light emitting element, and a characteristic parameter detecting unit for driving the pixel driving circuit of one of the plural pixels, which is a sensing pixel, sensing a voltage discharged in accordance with characteristics of a driving TFT in the pixel driving circuit of the sensing pixel, on a data line connected to the pixel driving circuit of the sensing pixel, among data lines connected to respective pixel driving circuits of the pixels, and detecting a threshold voltage (Vth) of the driving TFT and a deviation of a process characteristic parameter (k-parameter) of the driving TFT, using the measured voltage.

19 Claims, 13 Drawing Sheets

(56) References Cited

U.S. PATENT DOCUMENTS

| | | | | |
|---|---|---|---|---|
| 2010/0109718 | A1* | 5/2010 | Lin et al. | 327/109 |
| 2010/0134469 | A1 | 6/2010 | Ogura et al. | |
| 2010/0188320 | A1 | 7/2010 | Min et al. | |
| 2010/0214273 | A1 | 8/2010 | Shirouzu et al. | |
| 2011/0122119 | A1 | 5/2011 | Bae et al. | |
| 2011/0216056 | A1 | 9/2011 | Yoo et al. | |
| 2011/0242087 | A1* | 10/2011 | Ebisuno et al. | 345/212 |
| 2013/0050292 | A1* | 2/2013 | Mizukoshi | 345/690 |

FOREIGN PATENT DOCUMENTS

| | | | |
|---|---|---|---|
| DE | 10 2010 061 736 | A1 | 6/2011 |
| EP | 0 905 673 | | 3/1999 |
| KR | 10-2010-0127831 | | 12/2010 |

OTHER PUBLICATIONS

United Kingdom Intellectual Property Office, Office Action, U.K. Patent Application No. GB 1222816.9, Feb. 24, 2014, three pages United Kingdom Intellectual Property Office, Search and Examination Report, Patent Application No. GB 1222816.9, May 15, 2013, five pages.

State Intellectual Property Office of the People's Republic of China, First Office Action, Chinese Patent Application No. 201210532295.8, Aug. 27, 2014, fourteen pages.

German Patent Office, Office Action, German Patent Application No. 10 2012 112 569.4, Jan. 13, 2015, twelve pages.

* cited by examiner

ORGANIC LIGHT EMITTING DIODE DISPLAY DEVICE AND METHOD FOR SENSING CHARACTERISTIC PARAMETERS OF PIXEL DRIVING CIRCUITS

CROSS-REFERENCE TO RELATED APPLICATIONS

This application claims the benefit of Korean Patent Application No. 10-2011-0142040, filed on Dec. 26, 2011, which is hereby incorporated by reference as if fully set forth herein.

BACKGROUND OF THE INVENTION

1. Field of the Invention

The present invention relates to an organic light emitting diode (OLED) display device, and, more particularly, to the OLED display device and a method for sensing characteristic parameters of pixel driving circuits, which are capable of correcting non-uniformity of luminance through simple and rapid sensing of the characteristic parameters.

2. Discussion of the Related Art

An active matrix organic light emitting diode (AMOLED) display device is a self-luminous device in which an organic light emitting layer emits light through re-combination of electrons and holes. Since the AMOLED display device exhibits high luminance, and employs a low driving voltage while having an ultra-slim structure, it is expected to be a next-generation display device.

Such an AMOLED display device includes a plurality of pixels, each of which includes an organic light emitting diode (OLED) constituted by an anode, a cathode, and an organic light emitting layer interposed between the anode and the cathode, and a pixel driving circuit for independently driving the OLED. The pixel driving circuit mainly includes a switching thin film transistor (hereinafter, referred to as a "TFT"), a capacitor, and a driving TFT. The switching TFT charges the capacitor with a voltage corresponding to a data signal in response to a scan pulse. The driving TFT controls the amount of current supplied to the OLED in accordance with the level of the voltage charged in the capacitor, to adjust the amount of light emitted from the OLED. The amount of light emitted from the OLED is proportional to the amount of current supplied from the driving TFT to the OLED.

In such an AMOLED display device, however, TFT characteristics such as driving TFT threshold voltage Vth and process tolerance factors (e.g., mobility, parasitic capacitance, and channel width/length) are non-uniform among pixels due to process tolerances. For this reason, non-uniformity of luminance may occur in the AMOLED display device. To solve this problem, a data compensation method is employed. In accordance with this data compensation method, the characteristic parameters of the driving TFT in each pixel driving circuit are measured, and input data is adjusted, based on the result of the sensing.

The characteristics of the driving TFT may be measured through sensing of amounts of current flowing through the corresponding pixel at different voltages. For an AMOLED display device having an increased size, however, it is more difficult to rapidly measure amounts of current flowing through a number of pixels. For example, U.S. Pat. No. 7,834,825 discloses a method for sensing an amount of current flowing through a power line (a VDD or VSS line) of an OLED panel while turning on pixels one by one. However, this method has a problem in that there is a difficulty in achieving rapid sensing because the current sensing time is delayed due to parasitic capacitors present in parallel on the power line to achieve increased resolution.

Furthermore, in conventional cases, the system for sensing the characteristics of the driving TFT is complex. For this reason, after shipment, it is difficult to measure and compensate the characteristics of the driving TFT.

SUMMARY OF THE INVENTION

Accordingly, the present invention is directed to an OLED display device and method for sensing characteristic parameters of pixel driving circuits in an organic light emitting diode display device that substantially obviate one or more problems due to limitations and disadvantages of the related art.

An object of the present invention is to provide an OLED display device and method for sensing characteristic parameters of pixel driving circuits, which are capable of correcting non-uniformity of luminance through simple and rapid sensing of the characteristic parameters.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, an OLED display device includes a display panel including a plurality of pixels each having a light emitting element and a pixel driving circuit for independently driving the light emitting element, and a characteristic parameter detecting unit for sensing characteristic parameters of the pixel driving circuit in each of the plural pixels, the characteristic parameter detecting unit driving the pixel driving circuit of one of the plural pixels, which is a sensing pixel, sensing a voltage discharged in accordance with characteristics of a driving thin film transistor (TFT) in the pixel driving circuit of the sensing pixel, on a data line connected to the pixel driving circuit of the sensing pixel, among data lines connected to respective pixel driving circuits of the pixels, and detecting a threshold voltage (Vth) of the driving TFT and a deviation of a process characteristic parameter (k-parameter) of the driving TFT, using the measured voltage.

The characteristic parameter detecting unit may include a data driver for driving the data line, sensing a voltage on the data line, and outputting the measured voltage, and a timing controller for detecting the threshold voltage (Vth) and the k-parameter deviation, based on the measured voltage from the data driver, calculating an offset value to compensate the detected threshold voltage (Vth) and a gain value to compensate for the detected k-parameter deviation, storing the calculated offset value and the calculated gain value, compensating input data by use of the stored offset value and the stored gain value, and supplying the compensated input data to the data driver.

The timing controller may detect the threshold voltage (Vth) by calculating a difference voltage between the measured voltage from the data driver and a reference voltage supplied to the pixel driving circuit of the sensing pixel.

The timing controller may detect the k-parameter deviation by detecting a variation in the voltage discharged in accordance with the characteristics of the driving TFT in the sensing pixel, based on the measured voltage from the data driver, and calculating a ratio of the detected voltage variation in the sensing pixel to a predetermined or previously-detected voltage variation in a reference one of the pixels.

The pixel driving circuit may include the driving TFT, which drives the light emitting element, a first switching TFT for supplying the voltage on the data line to a first node of the driving TFT in response to a first scan signal from a scan line, a second switching TFT for supplying a reference voltage from a reference voltage line to a second node of the driving TFT in response to a second scan signal from the scan line, and a storage capacitor for charging a voltage between the first node and the second node, and supplying the charged voltage as a driving voltage for the driving TFT.

The data driver may supply a pre-charge voltage to the data line, then measure the voltage on the data line at a time when the driving TFT is driven in a saturated state in accordance with the discharge of the pre-charge voltage from the data line through driving of the first and second switching TFTs, and output the measured voltage. The timing controller may detect the threshold voltage (Vth) by calculating a difference voltage between the measured voltage from the data driver and a reference voltage supplied to the pixel driving circuit of the sensing pixel.

A first reference voltage may be supplied to the reference voltage line. The data driver may supply a pre-charge voltage to the data line, then measure the voltage on the data line at a plurality of times when the driving TFT is driven in a saturated state in accordance with the discharge of the pre-charge voltage from the data line through driving of the first and second switching TFTs, and output the measured voltages as first measured voltages. A second reference voltage different from the first reference voltage may be supplied to the reference voltage line. The data driver may supply the pre-charge voltage to the data line, then measure the voltage on the data line at the plurality of times when the driving TFT is driven in the saturated state in accordance with the discharge of the pre-charge voltage from the data line through the driving of the first and second switching TFTs, and output the measured voltages as second measured voltages. The timing controller may detect the threshold voltage (Vth) by detecting a time when a difference voltage between corresponding ones of the first and second measured voltages output from the data driver is equal or similar to a difference voltage between the first and second reference voltages, and then calculating a difference voltage between the first measured voltage measured at the detected time and the first reference voltage or a difference voltage between the second measured voltage measured at the detected time and the second reference voltage.

In a programming period, the data driver may supply, to the data line, a sum of a data voltage compensated for the detected threshold voltage (Vth) and the reference voltage, and the driving TFT is driven in accordance with the driving of the first and second switching TFTs. In a pre-charging period following the programming period, the data driver may pre-charge the data line with the pre-charge voltage, and the first and second switching TFTs are turned off. In a discharging period following the pre-charging period, the data driver may be disconnected from the data line, and the pre-charge voltage on the data line is discharged through the first switching TFT and the driving TFT. At a sensing time corresponding to the sensing time or each of the sensing times and following the discharging period, the first switching TFT may be turned off, and the data driver may measure the voltage on the data line, and outputs the measured voltage. The timing controller may detect the k-parameter deviation by calculating a difference voltage between the pre-charge voltage and the voltage measured at the sensing time, to detect a voltage variation in the sensing pixel, and calculating a ratio of the voltage variation in the sensing pixel to a voltage variation in reference to one of the pixels.

The data driver may include a plurality of digital-analog converters (DACs) for converting input data into analog data voltages by channels, respectively, a plurality of sampling/holder circuits respectively connected to the data lines by channels, each of the sampling/holder circuits sampling a voltage on a corresponding one of the data lines, and holding and outputting the sampled voltage as the measured voltage, an analog to digital converter (ADC) for converting the measured voltage from each of the sampling/holder circuits into digital data, and outputting the digital data, and a plurality of first switches connected between the DACs and the data lines by channels, respectively, to switch respective output voltages from the DACs.

The data driver may further include a multiplexer/scaler connected between the sampling/holder circuits and the ADC. The multiplexer/scaler may select and scale a plurality of measured voltages from the sampling/holder circuits by groups, and output the scaled voltages to the ADC, each group including at least one measured voltage. The ADC may be equal, in number, to output channels of the multiplexer/scaler.

The data driver may further include second switches that pre-charge voltages to respective output channels of the DACs.

In another aspect of the present invention, a method for sensing characteristic parameters of pixel driving circuits in an OLED display device including a plurality of pixels each including a light emitting element and a corresponding one of the pixel driving circuits to independently drive the light emitting element includes the steps of driving the pixel driving circuit of one of the plural pixels, which is a sensing pixel, sensing a voltage discharged in accordance with characteristics of a driving thin film transistor (TFT) in the pixel driving circuit of the sensing pixel, on a data line connected to the pixel driving circuit of the sensing pixel, among data lines connected to respective pixel driving circuits of the pixels, and detecting a threshold voltage (Vth) of the driving TFT, using the measured voltage, and driving the pixel driving circuit of the sensing pixel, using data voltage compensated for the detected threshold voltage (Vth), sensing a voltage discharged in accordance with the characteristics of the driving TFT, on the data line, and detecting a k-parameter deviation of the driving TFT, based on the measured voltage.

The step of detecting the threshold voltage (Vth) may include the step of calculating a difference voltage between the measured voltage and a reference voltage supplied to the pixel driving circuit of the sensing pixel, to detect the threshold voltage (Vth).

The step of detecting the k-parameter variation may include the step of detecting a variation in the voltage discharged in accordance with the characteristics of the driving TFT in the sensing pixel, based on the measured voltage, and calculating a ratio of the detected voltage variation in the sensing pixel to a predetermined or previously-detected voltage variation in a reference one of the pixels.

The pixel driving circuit may include the driving TFT, which drives the light emitting element, a first switching TFT for supplying the voltage on the data line to a first node of the driving TFT in response to a first scan signal from a scan line, a second switching TFT for supplying a reference voltage from a reference voltage line to a second node of the driving TFT in response to a second scan signal from the scan line, and a storage capacitor for charging a voltage between the first node and the second node, and supplying the charged voltage as a driving voltage for the driving TFT. The step of detecting the threshold voltage (Vth) may include the steps of supplying a pre-charge voltage to the data line, and then sensing the voltage on the data line at a time when the driving TFT is driven in a saturated state in accordance with the discharge of the pre-charge voltage from the data line through driving of the first and second switching TFTs, and calculating a difference voltage between the measured voltage and the reference voltage, to detect the threshold voltage (Vth).

The pixel driving circuit may include the driving TFT, which drives the light emitting element, a first switching TFT for supplying the voltage on the data line to a first node of the driving TFT in response to a first scan signal from a scan line, a second switching TFT for supplying a reference voltage from a reference voltage line to a second node of the driving TFT in response to a second scan signal from the scan line, and a storage capacitor for charging a voltage between the first node and the second node, and supplying the charged voltage as a driving voltage for the driving TFT. The step of detecting the threshold voltage (Vth) may include the steps of supplying a first reference voltage to the reference voltage line, supplying a pre-charge voltage to the data line, sensing the voltage on the data line at a plurality of times when the driving TFT is driven in a saturated state in accordance with discharge of the pre-charge voltage from the data line through driving of the first and second switching TFTs, and outputting the measured voltages as first measured voltages, supplying a second reference voltage different from the first reference voltage to the reference voltage line, supplying the pre-charge voltage to the data line, sensing the voltage on the data line at the plurality of times when the driving TFT is driven in the saturated state in accordance with the discharge of the pre-charge voltage from the data line through the driving of the first and second switching TFTs, and outputting the measured voltages as second measured voltages, and detecting a time when a difference voltage between corresponding ones of the first and second measured voltages output from the data driver is equal or similar to a difference voltage between the first and second reference voltages, and calculating a difference voltage between the first measured voltage measured at the detected time and the first reference voltage or a difference voltage between the second measured voltage measured at the detected time and the second reference voltage, to detect the threshold voltage (Vth).

The step of detecting the k-parameter deviation may include the steps of supplying, in a programming period, a sum of a data voltage compensated for the detected threshold voltage (Vth) and the reference voltage to the data line, and driving the driving TFT in accordance with the driving of the first and second switching TFTs, pre-charging, in a pre-charging period following the programming period, the data line with the pre-charge voltage, and turning off the first and second switching TFTs, floating the data line in a discharging period following the pre-charging period, and discharging the pre-charge voltage on the data line through the first switching TFT and the driving TFT, turning off the first switching TFT at a sensing time, which corresponds to the sensing time or each of the sensing times and follows the discharging period, and sensing the voltage on the data line, calculating a difference voltage between the pre-charge voltage and the voltage measured at the sensing time, to detect a voltage variation in the sensing pixel, and calculating a ratio of the voltage variation in the sensing pixel to a voltage variation in a reference one of the pixels, to detect the k-parameter deviation.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and along with the description serve to explain the principle of the invention. In the drawings.

DETAILED DESCRIPTION OF THE INVENTION

Reference will now be made in detail to the preferred embodiments of the present invention, examples of which are illustrated in the accompanying drawings.

Hereinafter, an OLED display device and method for sensing characteristic parameters of pixel driving circuits in accordance with the present invention will be described in detail.

The current, Ids, of a driving thin film transistor (TFT) determines the amount of light emitted from an organic light emitting diode (OLED) of each pixel in an AMOLED display device is determined by characteristic parameters of the driving TFT such as a threshold voltage Vth of the driving TFT and a k-parameter of the driving TFT, as well as a driving voltage Vgs of the driving TFT, as expressed in the following Equation 1:

$$Ids = \frac{1}{2} \cdot \frac{W}{L} \cdot \mu \cdot Cox \cdot (Vgs - Vth)^2 = k \cdot (Vgs - Vth)^2 \quad \text{[Equation 1]}$$

In Equation 1, "k" represents a process characteristic factor and includes process characteristic factor components such as the ratio of channel width (W) to channel length (L), W/L, mobility μ, and parasitic capacitance Cox in the driving TFT. The threshold voltage Vth and k-parameter of the driving TFT may cause the current of the driving TFT to be non-uniform even when the driving voltage Vgs is constant. That is, the threshold voltage Vth and k-parameter are factor components causing non-uniformity of luminance. To this end, in accordance with the present invention, the threshold voltage Vth and k-parameter are measured for each pixel during an inspection process and/or a display operation.

In the OLED display device and method for sensing characteristic parameters of pixel driving circuits in accordance with the present invention, the threshold voltage Vth and k-parameter of the driving TFT in each pixel driving circuit are individually measured through a corresponding data line and a data driver under the condition that the driving TFT is driven by constant current.

Figure 1:
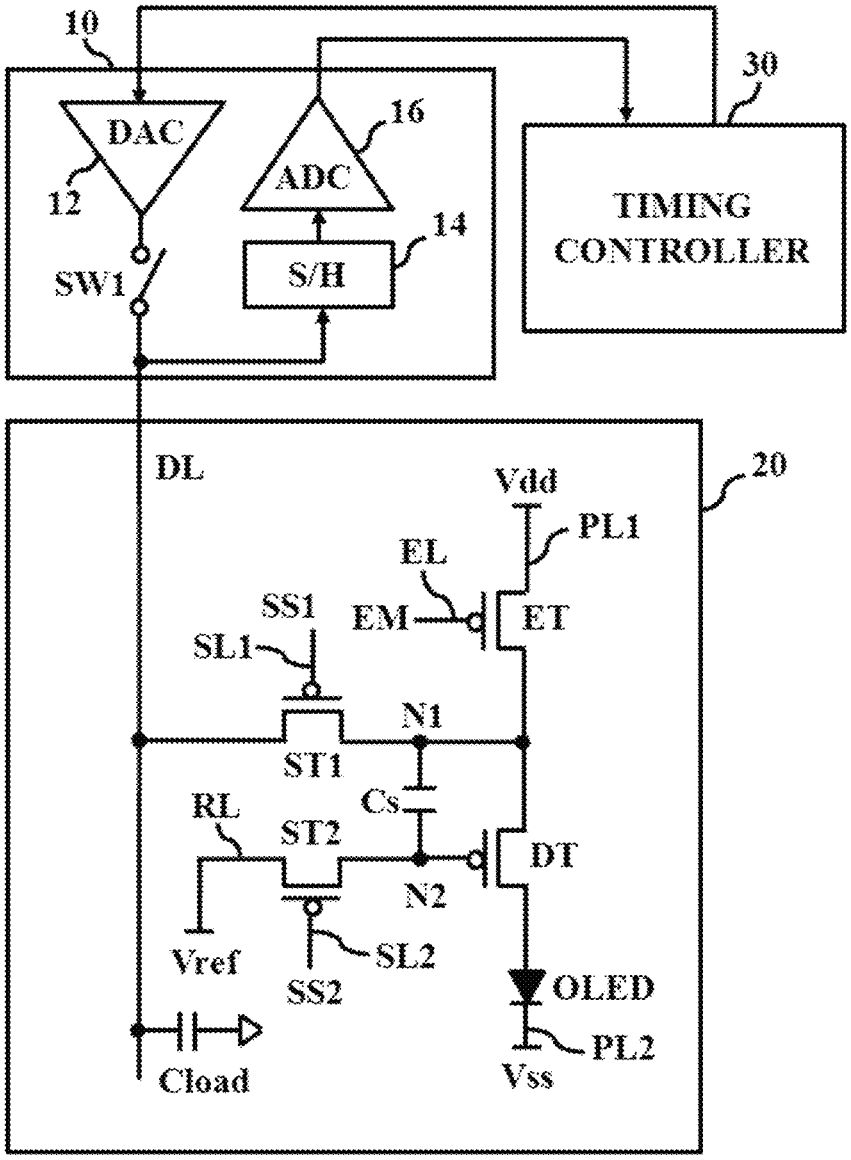
FIG. 1 is a circuit diagram illustrating an active matrix organic light emitting diode (AMOLED) display device having a function of sensing characteristic parameters of pixel driving circuits in accordance with an exemplary embodiment of the present invention.

FIG. 1 illustrates an AMOLED display device having a function of sensing characteristic parameters of pixel driving circuits in accordance with an exemplary embodiment of the present invention.

The AMOLED display device shown in FIG. 1 includes a display panel 20 formed with pixel driving circuits, a data driver 10 for driving data lines DL of the display panel 20 and sensing a voltage to be used for sensing of characteristic parameters of each pixel driving circuit such as a threshold voltage Vth and a k-parameter deviation, through a corresponding one of the data lines DL, and a timing controller 30 for detecting the characteristic parameters of each pixel driving circuit, based on the measured voltage from the data driver 10 for the pixel driving circuit, and compensating the detected characteristic parameters. The data driver 10 and timing controller 30 function as characteristic parameter detection means. The display device shown in FIG. 1 also includes a scan driver (not shown) for driving scan lines SL1 and SL2 of the pixel driving circuits, and an emission controller (not shown) for driving emission control lines EL. The AMOLED display device selectively operates in a sensing mode to measure the characteristic parameter of each pixel driving circuit or a display mode to perform general image display.

The data driver 10 includes a digital-to-analog converter (hereinafter, referred to as "DAC") 12 and an analog-to-digital converter (hereinafter, referred to as "ADC") 16, which are connected to each data line DL in parallel, a first switch SW1 connected between the DAC 12 and the data line DL, and a sampling/holder (S/H) circuit 14 connected between the ADC 16 and the data line DL. The data driver 10 further includes an output buffer (not shown) connected between the DAC 12 and the first switch SW1.

In either the sensing mode or the display mode, the DAC 12 converts input data from the timing controller 30 into analog data voltage Vdata, and supplies the analog data voltage Vdata to the data line DL of the display panel 20 via the first switch SW1. In the sensing mode, the S/H circuit 14 measures a voltage on the data line DL, for calculation of the threshold voltage Vth and k-parameter of the pixel driving circuit connected to the data line DL, and outputs the measured voltage. The ADC 16 converts the measured voltage into digital data.

Each pixel driving circuit includes first and second switching TFTs ST1 and ST2, a driving TFT DT, an emission control TFT ET, and a storage capacitor Cs, in order to independently drive an OLED. The pixel driving circuit also includes first and second scan lines SL1 and SL2 for supplying first and second scan signals SS1 and SS2 as control signals for the first and second switching TFTs ST1 and ST2, respectively, and an emission control line EL for supplying an emission control signal EM as a control signal for the emission control TFT ET. The data line DL is also included in the pixel driving circuit. The data line DL supplies a pre-charge voltage Vpre and the data voltage Vdata to the first switching TFT ST1. The pixel driving circuit further includes a reference voltage line RL for supplying a reference voltage Vref to the second switching TFT ST2, a first power line PL1 for supplying a high-level voltage VDD to the emission control TFT ET, and a second power line PL2 for supplying a low-level voltage VSS to a cathode of the OLED. The pixel driving circuit is driven in either the sensing mode for sensing of deviations of the threshold voltage Vth and k-parameter of the driving TFT DT or the display mode for data display.

The OLED is connected to the driving TFT DT in series between the first power line PL1 and the second power line PL2. In addition to the cathode, which is connected to the second power line PL2, the OLED includes an anode connected to the driving TFT DT, and a light emitting layer arranged between the anode and the cathode. The light emitting layer includes an electron injection layer, an electron transport layer, an organic light emitting layer, a hole transport layer, and a hole injection layer. In the OLED, electrons from the cathode are supplied to the organic light emitting layer via the electron injection layer and electron transport layer when a positive bias is applied between the anode and the cathode, and holes from the anode to the organic light emitting layer via the hole injection layer and hole transport layer. Accordingly, the organic light emitting layer fluoresces or phosphoresces through re-combination of the supplied electrons and holes. Thus, the OLED generates luminance proportional to the density of current supplied to the OLED.

The first switching TFT ST1 includes a gate electrode connected to the first scan line SL1, a first electrode connected to the data line DL, and a second electrode connected to a first node N1. The first and second electrodes function as source and drain electrodes or vice versa, respectively, in accordance with the direction of current flowing through the first switching TFT ST1. In the sensing mode, the first switching TFT ST1 supplies the pre-charge voltage Vpre from the data line DL to the first node N1 in response to the first scan signal SS1 supplied from the scan driver to the first scan line SL1. In either the sensing mode or the display mode, the first switching TFT ST1 supplies the data voltage Vdata from the data line DL to the first node N1 in response to the first scan signal SS1 supplied to the first scan line SL1.

The second switching TFT ST2 includes a gate electrode connected to the second scan line SL2, a first electrode connected to the reference voltage line RL, and a second electrode connected to a second node N2 connected to a gate electrode of the driving TFT DT. The first and second electrodes of the second switching TFT ST2 function as source and drain electrodes or vice versa, respectively, in accordance with the direction of current flowing through the second switching TFT ST2. In either the sensing mode or the display mode, the second switching TFT ST2 supplies the reference voltage Vref from the reference voltage line RL to the second node N2 in response to the second scan signal SS2 supplied from the scan driver to the second scan line SL2.

The storage capacitor Cs is charged with a difference voltage between the pre-charge voltage Vpre supplied to the first node N1 and the reference voltage Vref supplied to the second node N2 or a difference voltage between the data voltage Vdata and the reference voltage Vref. The storage capacitor Cs supplies the charged voltage as the driving voltage Vgs of the driving TFT DT.

The gate electrode of the driving TFT DT is connected to the second node N2. The driving TFT DT also includes a first electrode connected to the first power line PL1 via the emission control TFT ET, and a second electrode connected to the anode of the OLED. The first and second electrodes of the driving TFT DT function as source and drain electrodes or vice versa, respectively, in accordance with the direction of current flowing through the driving TFT DT. The driving TFT DT supplies an amount of current, which corresponds to the driving voltage supplied from the storage capacitor Cs, to the OLED which, in turn, emits light.

The emission control TFT ET includes a gate electrode connected to the emission control line EL, a first electrode connected to the first power line PL1, and a second electrode connected to the first node N1. The first and second electrodes of the emission control TFT ET function as source and drain electrodes or vice versa, respectively, in accordance with the direction of current flowing through the emission control TFT ET. In response to the emission control signal EM supplied from the emission controller to the emission control line EL, the emission control TFT ET supplies the high-level voltage VDD to the driving TFT DT only in a display period in the display mode. In either the sensing mode or a non-display period in the display mode, the emission control TFT ET prevents supply of the high-level voltage VDD, to avoid an increase of black luminance.

In the display mode, the first switch SW1 is turned on. The DAC 12 converts input data into data voltage Vdata, and supplies the data voltage Vdata to the data line DL via the first switch SW1. In this case, when the first and second switching TFTs ST1 and ST2 are turned on in response to the first and second scan signals SS1 and SS2, respectively, the storage capacitor Cs is charged with a difference voltage "Vdata−Vref" between the data voltage Vdata and the reference voltage Vref. When the first and second switching TFTs ST1 and ST2 are turned off in response to the first and second scan signals SS1 and SS2, respectively, and the emission control TFT ET is turned on in response to the emission control signal EM, the driving TFT DT supplies the driving current according to the voltage charged in the storage capacitor CS to the OLED which, in turn, emits light.

In the sensing mode, the data driver 10 drives the driving TFT DT of each pixel driving circuit, using constant current, measures a voltage on the data line DL connected to the pixel driving circuit, for calculation of the threshold voltage Vth and k-parameter of the pixel driving circuit, and outputs the measured voltage. For respective pixel driving circuits, the voltage sensing operation of the data driver 10 is carried out in a sequential manner. Sensing of the threshold voltage Vth and k-parameter will be described in detail later.

The timing controller 30 detects characteristic parameters such as a threshold voltage Vth and a k-parameter deviation, through a predetermined equation using the voltage measured for each pixel by the data driver 10. The timing controller 30 then sets an offset value for compensation of the detected threshold voltage Vth and a gain value for compensation for the detected k-parameter deviation, and stores the set offset value and gain value for each pixel in a memory (not shown). Also, the timing controller 30 compensates input data, using the offset value and gain value stored for each pixel in the memory, and supplies, to the data driver 10, data compensated for the characteristic parameters of the pixel driving circuit of the pixel.

Sensing Threshold Voltage Vth and First Compensation Method

Figure 2A:
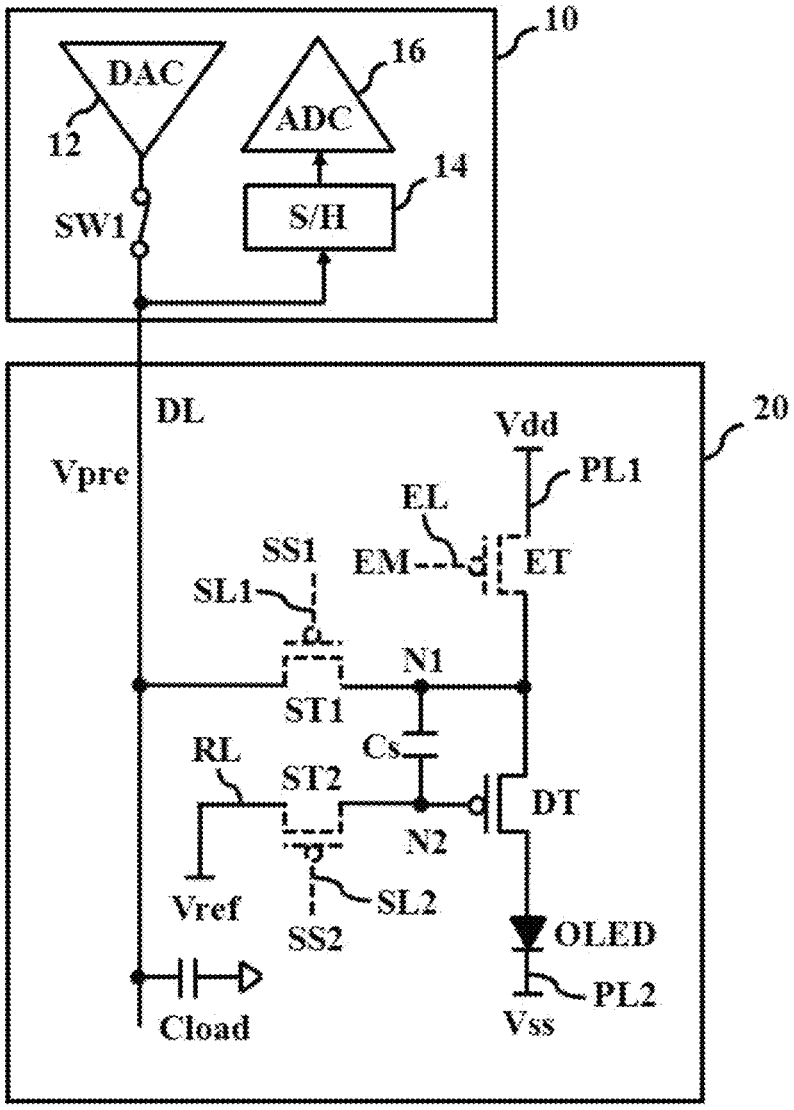
FIGS. 2A and 2B are circuit diagrams illustrating sequential steps of a method for sensing a threshold voltage Vth of each pixel driving circuit in accordance with a first embodiment of the present invention.
Figure 2B:
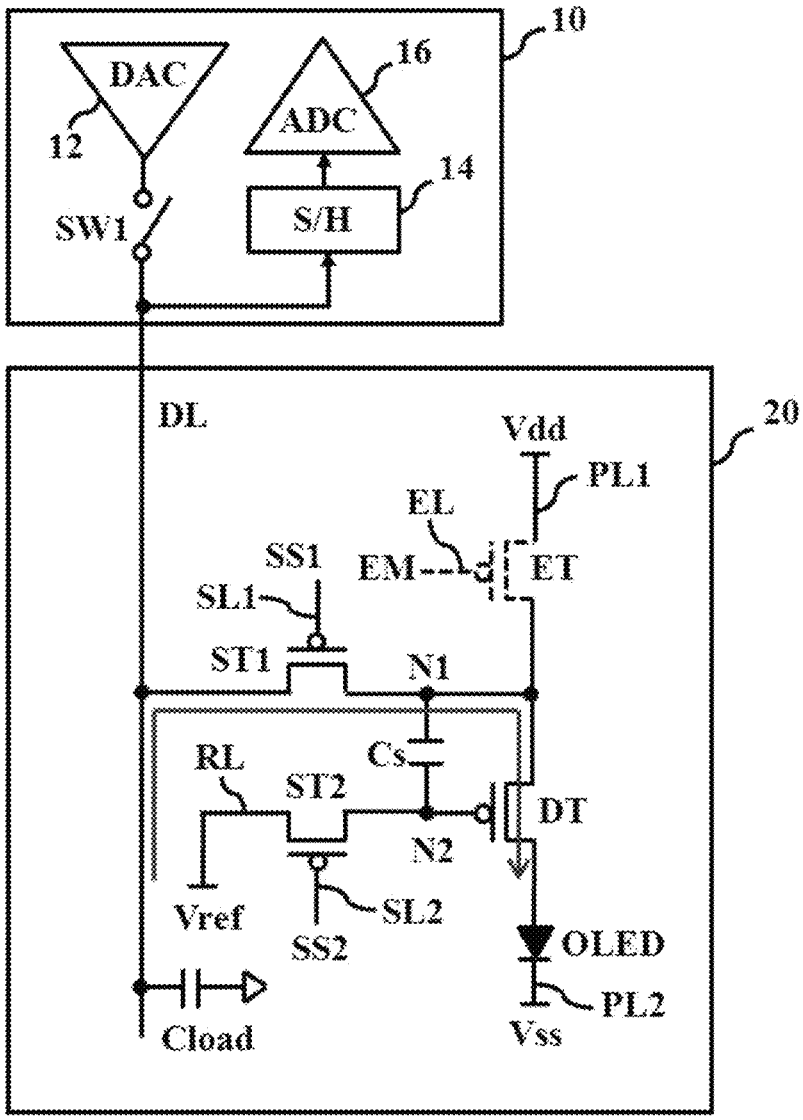
Figure 3:
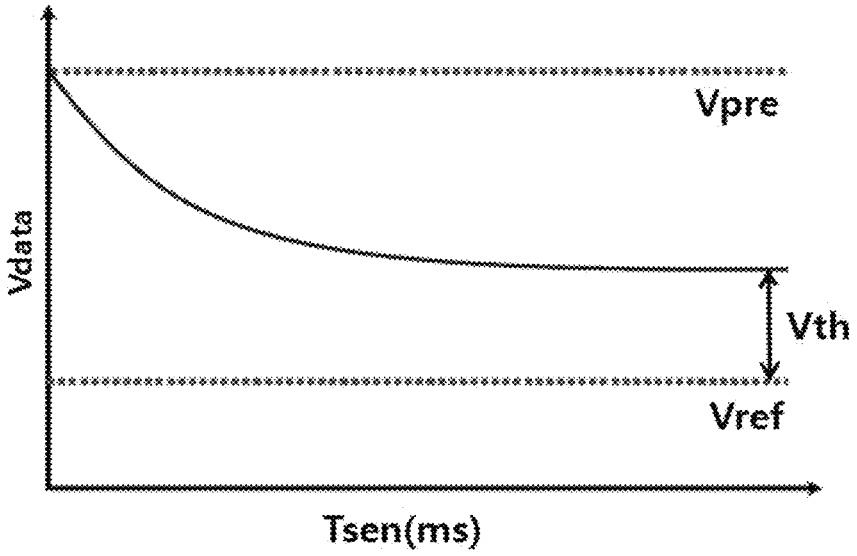
FIG. 3 is a graph depicting variation in output voltage on a data line according to passage of time in the case of FIGS. 2A and 2B.

FIGS. 2A and 2B are circuit diagrams illustrating sequential steps of a method for sensing a threshold voltage Vth of each pixel driving circuit in accordance with a first embodiment of the present invention. FIG. 3 is a graph depicting variation in the output voltage on the data line according to passage of time in the case of FIGS. 2A and 2B.

As shown in FIG. 2A, the DAC 12 supplies the pre-charge voltage Vpre to the data line DL via the turned-on first switch SW1. The pre-charge voltage Vpre may be supplied from an external voltage source to the data line DL via the first switch SW1. Thereafter, as shown in FIG. 2B, the first switch SW is turned off, and the first and second switching TFTs ST1 and ST2 are turned on. Accordingly, the driving TFT DT is driven in a saturated region by the difference voltage between the pre-charge voltage Vpre and the reference voltage Vref, which is charged in the storage capacitor Cs. As a result, the pre-charge voltage Vpre from the data line DL is discharged through the first switching TFT ST1, driving TFT DT, and OLED. When the voltage of the storage capacitor Cs reaches the threshold voltage Vth of the driving TFT DT in accordance with discharge of the pre-charge voltage Vpre, the voltage on the data line DL is saturated, as shown in FIG. 3. At a time T1 when the voltage on the data line DL is saturated, the S/H circuit 14 measures the voltage on the data line DL, namely, a voltage Vsen, and outputs the measured voltage Vsen. The ADC 14 converts the measured voltage Vsen from the S/H circuit 14 into digital data, and outputs the digital data. The timing controller 30 calculates a difference voltage "Vref−Vsen" between the reference voltage Vref and the measured voltage Vsen, to detect the threshold voltage Vth of the driving TFT DT. The timing controller 30 then sets an offset value for compensation of the detected threshold voltage Vth, and stores the offset value. Offset value setting and storage of the timing controller 30 are carried out for each pixel.

Sensing Threshold Voltage Vth and Second Compensation Method

Figure 4A:
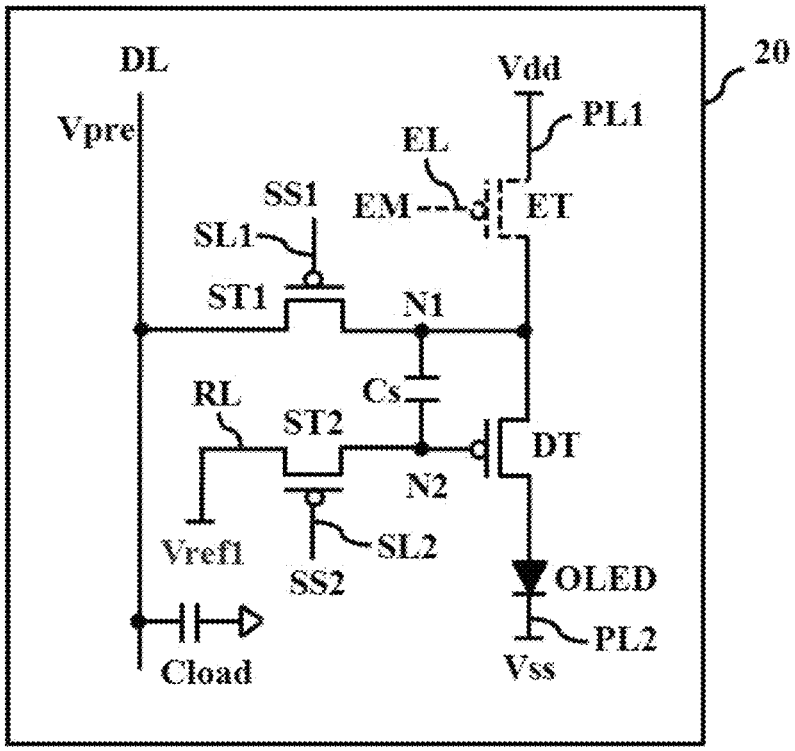
FIGS. 4A and 4B are circuit diagrams illustrating sequential steps of a method for sensing a threshold voltage Vth of each pixel driving circuit in accordance with a second embodiment of the present invention.
Figure 4B:
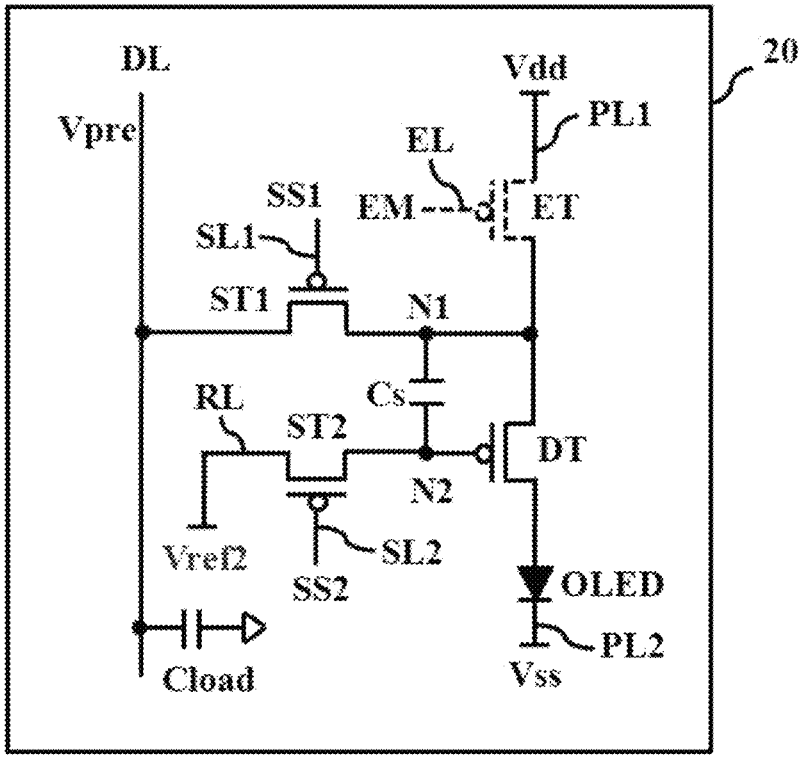
Figure 5:
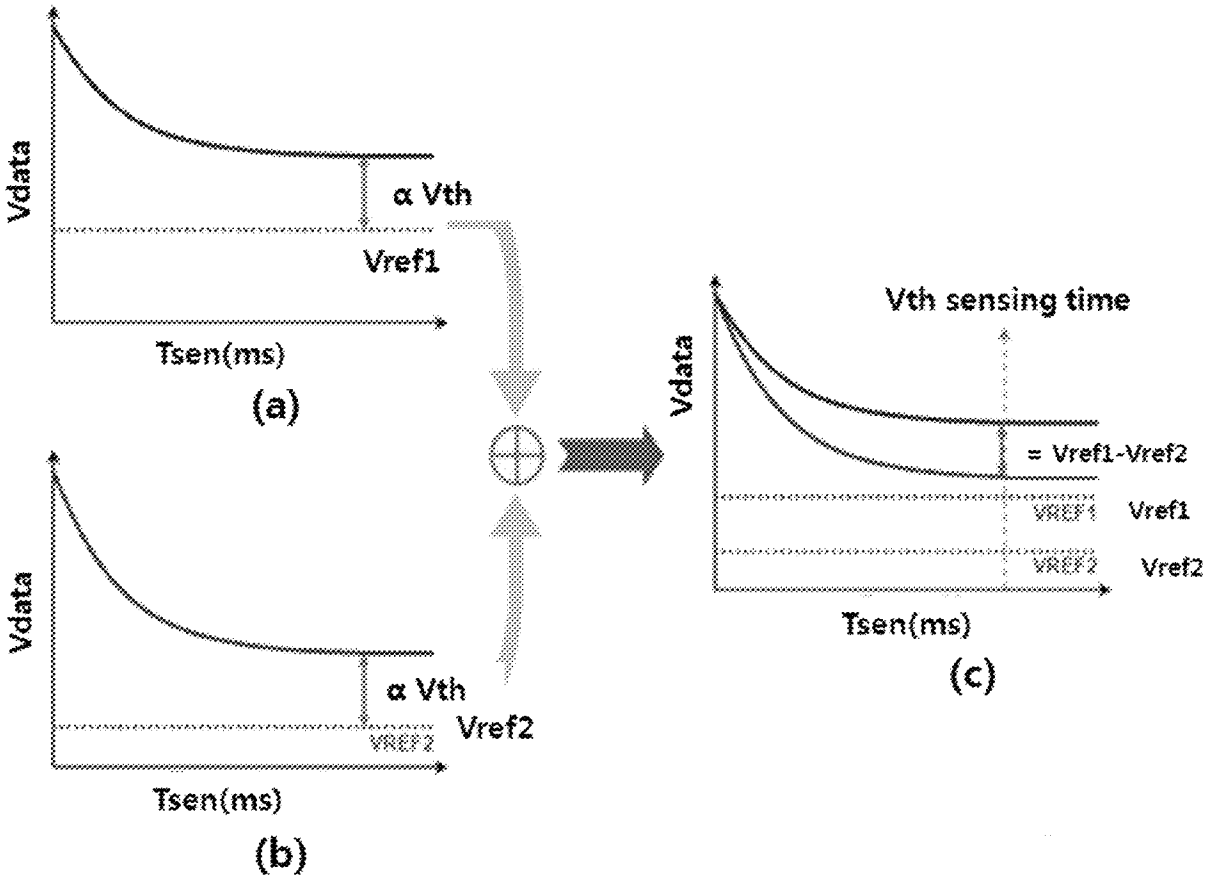
FIG. 5 is a graph depicting variation in the output voltage on the data line according to passage of time in the case of FIGS. 4A and 4B.

FIGS. 4A and 4B are circuit diagrams illustrating sequential steps of a method for sensing a threshold voltage Vth of each pixel driving circuit in accordance with a second embodiment of the present invention. FIG. 5 is a graph depicting variation in the output voltage on the data line according to passage of time in the case of FIGS. 4A and 4B.

As shown in FIG. 4A, after supply of the pre-charge voltage Vpre to the data line DL and supply of a first reference voltage Vref1 to the reference voltage line RL, the first and second switching TFTs ST1 and ST2 are turned on. Accordingly, the driving TFT DT is driven. The S/H circuit measures a voltage Vsen1 on the data line DL at a plurality of times when the voltage Vsen1 is saturated in accordance with discharge of the pre-charge voltage Vpre from the data line DL through the first switching TFT ST1, driving TFT DT, and OLED, as shown in FIG. 5(*a*). The S/H circuit 14 then outputs the measured voltages.

Thereafter, as shown in FIG. 4B, the pre-charge voltage Vpre is again supplied to the data line DL, and a second reference voltage Vref2 different from the first reference voltage Vref1 is supplied to the reference voltage line RL. The first and second switching TFTs ST1 and ST2 are then turned on, thereby causing the driving TFT DT to be turned on. The S/H circuit 14 measures a voltage Vsen2 on the data line DL at a plurality of times when the voltage Vsen2 is saturated in accordance with discharge of the pre-charge voltage Vpre from the data line DL through the first switching TFT ST1, driving TFT DT, and OLED, as shown in FIG. 5(*b*). The S/H circuit 14 then outputs the measured voltages through the ADC 16.

Meanwhile, the timing controller 30 defines, as a threshold voltage (Vth) sensing time, the time when the difference voltage "Vsen1−Vsen2" between the first measured voltage Vsen1 measured in the case of FIG. 4A and the second measured voltage Vsen2 measured in the case of FIG. 4B is equal to the difference voltage "Vref1−Vref2" between the first reference voltage Vref1 and the second reference voltage Vref2 as shown in FIG. 5(*c*). The timing controller 30 calculates a difference voltage "Vref1−Vsen1" between the first reference voltage Vref1 and the first measured voltage Vsen1 measured at the Vth sensing time or a difference voltage "Vref2−Vsen2" between the second reference voltage Vref2 and the second measured voltage Vsen2, to detect the threshold voltage Vth of the driving TFT DT. The timing controller 30 then sets an offset value for compensation of the detected threshold voltage Vth, and stores the offset value. Offset value setting and storage of the timing controller 30 are carried out for each pixel.

Sensing k-Parameter and Compensation Method

Figure 6A:
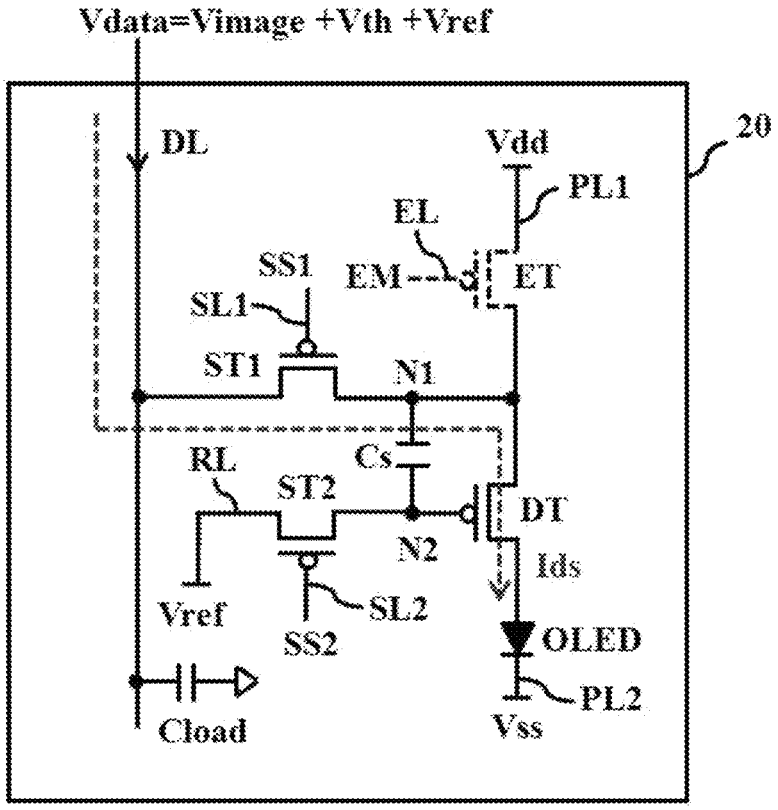
FIGS. 6A to 6C are circuit diagrams illustrating sequential steps of a method for sensing a k-parameter of each pixel driving circuit in accordance with an embodiment of the present invention.
Figure 6B:
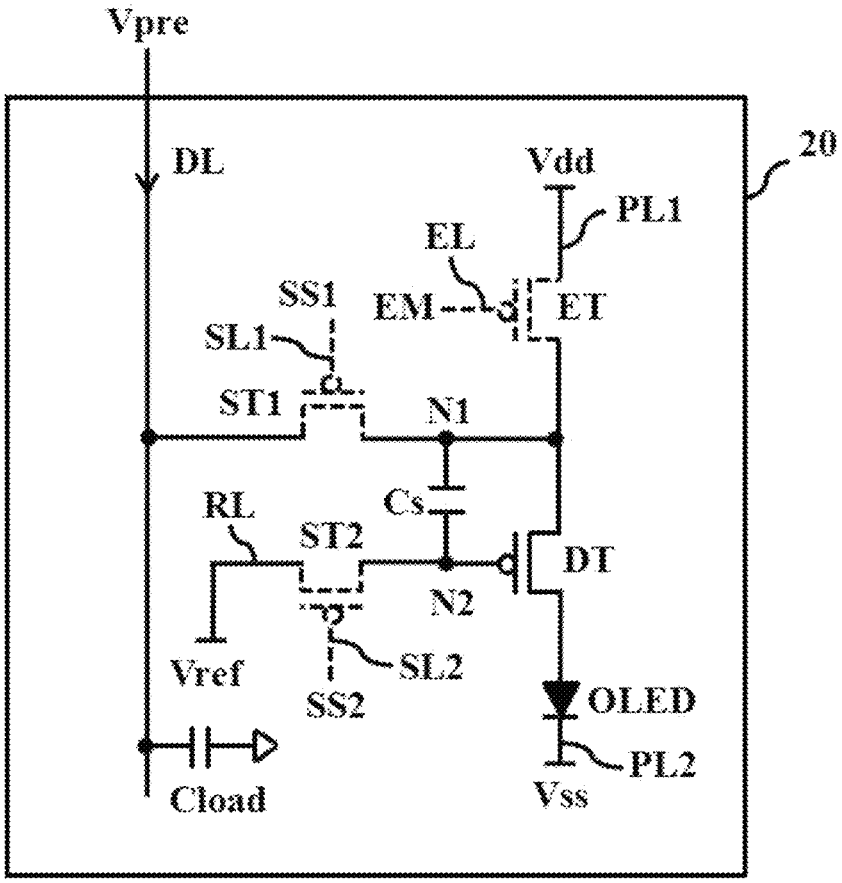
Figure 6C:
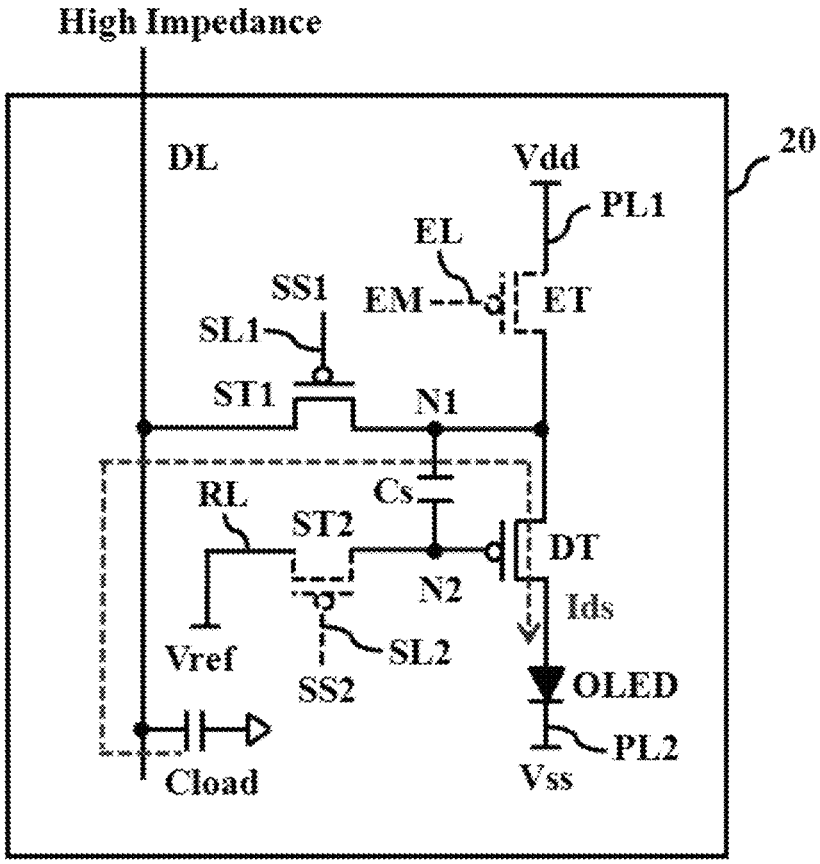
Figure 7:
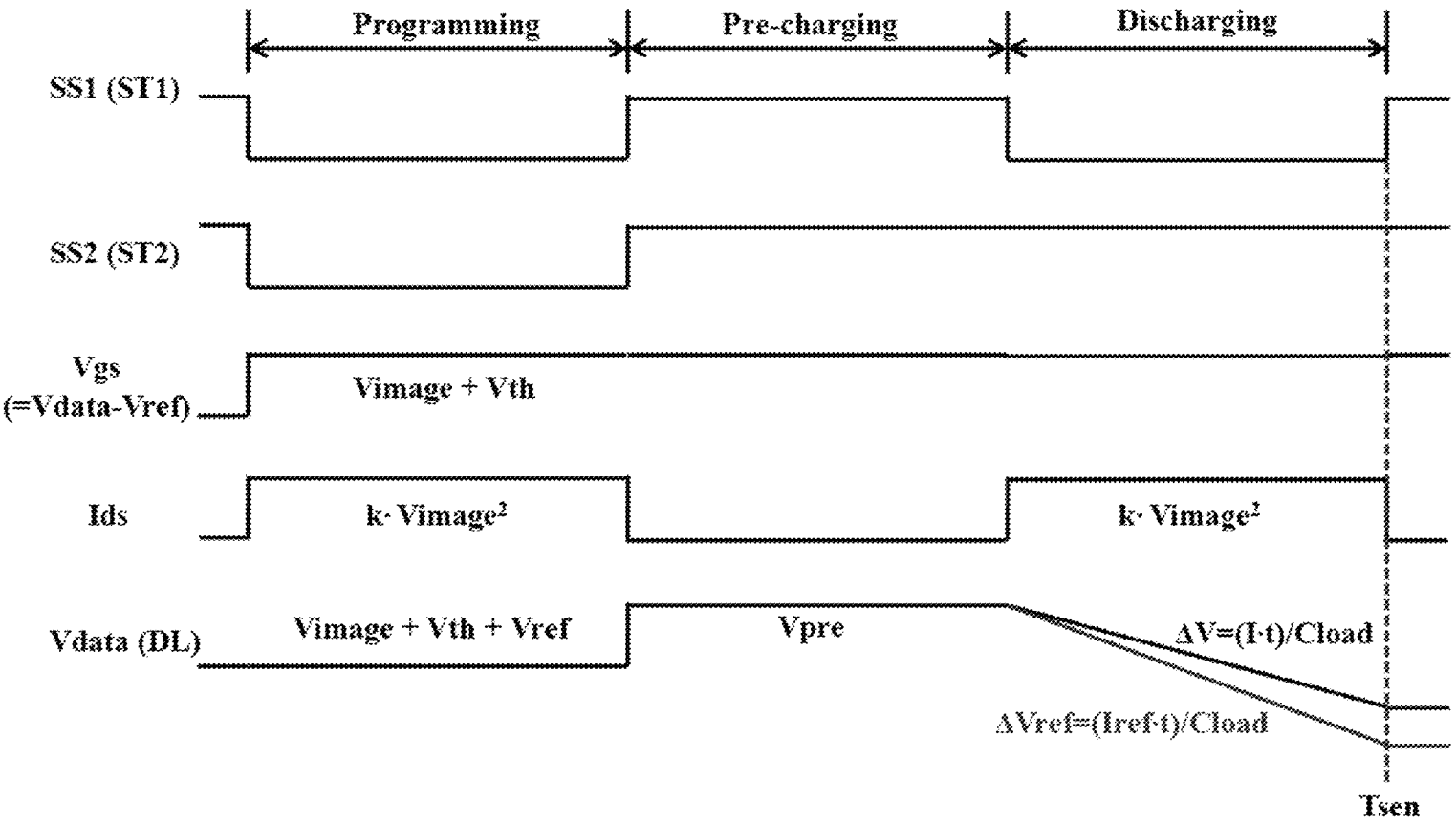
FIG. 7 is a waveform diagram illustrating driving of the pixel driving circuit shown in FIGS. 6A to 6C.

FIGS. 6A to 6C are circuit diagrams illustrating sequential steps of a method for sensing a k-parameter of each pixel driving circuit in accordance with an embodiment of the present invention. FIG. 7 is a waveform diagram illustrating driving of the pixel driving circuit shown in FIGS. 6A to 6C.

In a programming period in FIG. 7, as shown in FIG. 6A, the DAC 12 applies the threshold voltage Vth detected at a preceding stage to the data line DL via the turned-on first switch SW1, and thus supplies a sum of the compensated data voltage Vdata (Vdata=Vimage+Vth) and the reference voltage Vref, namely, a sum voltage "Vimage+Vth+Vref". In the programming period, the first and second switching TFTs ST1 and ST2 are turned on by the first and second scan signals SS1 and SS2, respectively. As a result, the storage capacitor Cs is charged with the data voltage Vdata (Vdata=Vimage+Vth), which has been compensated for the threshold voltage Vth. Accordingly, the data voltage Vdata (Vdata=Vimage+Vth) is supplied as the driving voltage Vgs of the driving TFT DT. Thus, the driving TFT DT supplies current Ids proportional to the k-parameter and data voltage Vimage, as expressed by the following Equation 2:

$$Ids=k\times Vimage^2 \quad \text{[Equation 2]}$$

In a pre-charging period in FIG. 7, as shown in FIG. 6B, the DAC 12 charges the data line DL with the pre-charge voltage Vpre via the first switch SW1. Also, the first and second switching TFTs ST1 and ST2 are turned off by the first and second scan signals SS1 and SS2, respectively. The pre-charge voltage Vpre may be equal to the reference voltage Vref.

In a discharging period in FIG. 7, as shown in FIG. 6C, the first switch SW1 is turned off, thereby causing the data line DL to be floated. The first switching TFT ST1 is turned on by the first scan signal SS1. Accordingly, the driving TFT DT is driven in a saturated state and, as such, the pre-charge voltage Vpre of the data line DL is discharged through the first switching TFT ST1, driving TFT DT, and OLED. As a result, the voltage of the data line DL is dropped. Referring to FIG. 7, it can be seen that the voltage gradient of a reference pixel, namely, a voltage variation ΔVref, and the voltage gradient of a sensing pixel, a voltage variation ΔV, may be different from each other due to different k-parameter characteristics of driving TFTs DT.

Figure 8:
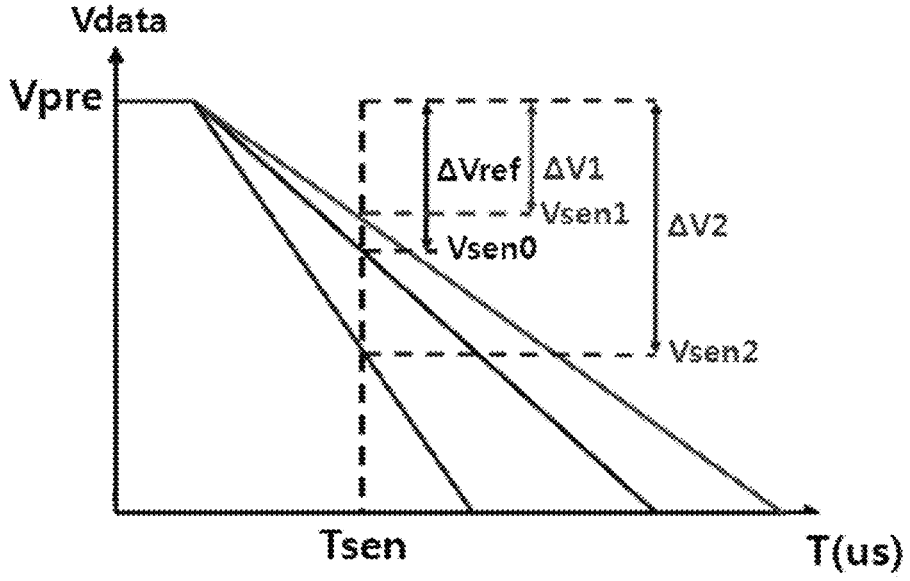
FIG. 8 is a graph depicting voltage variations of plural pixels in a pre-charging period and a discharging period in FIG. 7.

At a sensing time Tsen in FIG. 7, as shown in FIG. 6C, the first switching TFT ST1 is turned off by the first scan signal SS1. In this state, the S/H circuit 14 the voltage Vsen on the data line DL, and outputs the measured voltage Vsen via the ADC 16. As shown in FIG. 8, the timing controller 30 calculates a ratio of the difference voltage ΔRef between the pre-charge voltage Vpre and the measured voltage Vsen of the reference pixel at the sensing time Tsen (ΔRef=Vpre−Vsen0) to the difference voltage ΔV between the pre-charge voltage Vpre and the measured voltage Vsen1 or Vsen2 of the sensing pixel (ΔV=Vpre−Vsen1 or Vsen2), to detect a k-parameter ratio between the pixels (namely, the k-parameter ratio between the reference pixel and the sensing pixel). From the detected k-parameter ratio, a gain value for compensation for a k-parameter deviation between the pixels is detected. The detected gain value is then stored. In other words, the timing controller 30 calculates the ratio between the voltage variation ΔRef (ΔRef=Vpre−Vsen0) of the reference pixel generated during the discharging period and the voltage variation ΔV (ΔV=Vpre−Vsen1 or Vsen2) of the sensing pixel generated during the discharging period, to detect a k-parameter deviation between the pixels, and thus to detect a gain value for compensation for the detected k-parameter deviation. The timing controller 30 then stores the gain value.

Using the difference voltage ΔV between the pre-charge voltage Vpre and the measured voltage Vsen shown in FIG. 8 (ΔV=Vpre−Vsen), it may be possible to calculate the amount of current flowing through the driving TFT DT and to detect the k-parameter ratio between the pixels (namely, the k-parameter ratio between the reference pixel and the sensing pixel.

In detail, since the driving TFT DT is driven in a saturated region in the discharging period in FIG. 7, it can be seen that "ΔV" is proportional to the current of the driving TFT DT, as expressed by the following Equation 3. In Equation 3, "Cload" represents load applied to the data line DL, namely, the parasitic capacitance of the data line DL.

$$\Delta V = \frac{Ids\times t}{Cload} \quad \text{[Equation 3]}$$

Since the discharging period and "Cload" are constant, and the threshold voltage Vth has been compensated, it can be seen that the "ΔV" ratio between the reference pixel and the sensing pixel is equal to the current ratio between the reference pixel and the sensing pixel, and is also equal to the k-parameter ratio between the reference pixel and the sensing pixel, as expressed by the following Equation 4. It can also be seen that the "ΔV" ratio between the reference pixel and the sensing pixel is equal to the ratio between the measured voltage of the reference pixel at the specific sensing time Tsen shown in FIG. 8 and the measured voltage of the sensing pixel at the specific sensing time Tsen. Accordingly, it can be seen that the k-parameter deviation between pixels (that is, the k-parameter ratio between the reference pixel and the sensing pixel) can be easily calculated, using the ratio between the measured voltage Vsen0 of the reference pixel and the measured voltage Vsen1 or Vsen2 of the sensing pixel.

$$\frac{\Delta Vref}{\Delta V} = \frac{(Iref\times t)/Cload}{(I\times t)/Cload} = \frac{Iref}{I} = \frac{k_{ref}\times Vimage^2}{k\times Vimage^2} = \frac{k_{ref}}{k} \quad \text{[Equation 4]}$$

Meanwhile, "Vdata" for compensation of the threshold voltage Vth and k-parameter includes the "ΔV" ratio between the reference pixel and the sensing pixel, as expressed by the following Equation 5:

$$Vdata = \sqrt{\frac{k_{ref}}{k}} \times Vimage + Vth + Vref = \sqrt{\frac{\Delta Vref}{\Delta V}} \times Vimage + Vth + Vref \quad \text{[Equation 5]}$$

When "Vdata" calculated through Equation 5 is applied to a current equation as expressed by the following Equation 6, it can be seen that the current Ids of the driving TFT DT is expressed irrespective of the threshold voltage Vth and k-parameter of the driving TFT DT. That is, it can be seen that desired compensation has been made.

$$\begin{aligned} Ids &= k(Vgs - Vth)^2 \\ &= k(Vdata - Vref - Vth)^2 \\ &= k\left(\sqrt{\frac{\Delta Vref}{\Delta V}} \times Vimage\right)^2 \\ &= k \times \frac{Vref}{V} \times Vimage^2 \\ &= k_{ref} \times Vimage \end{aligned} \quad \text{[Equation 6]}$$

In other words, since the voltage Vgs to drive the driving TFT DT is a "Vth"-compensated voltage, the current of the driving TFT DT can be calculated through the following Equation 7:

$$\begin{aligned} I &= k(Vgs - Vth)^2 \\ &= k(Vdata + Vth - Vth)^2 \\ &= k \times Vdata^2 \end{aligned} \quad \text{[Equation 7]}$$

Since the current of the driving TFT DT in the reference pixel, which has a standard k-parameter, namely, a k'-parameter, and the current of the driving TFT DT in the sensing pixel, which has a k-parameter, should be equal, the driving voltage V'data of the reference pixel and the driving voltage Vdata of the sensing pixel can be expressed, using the ratio between the k'-parameter of the reference pixel and the k-parameter of the sensing pixel, as expressed by the following Equation 8:

$$k \times Vdata^2 = k' \times V'data^2 \quad \text{[Equation 8]}$$

$$V'data = \sqrt{\frac{k}{k'}} \times Vdata$$

Accordingly, the threshold voltage Vth and k-parameter of the driving TFT in the sensing pixel can be compensated through calculation of the gain value for compensation for the k-parameter ratio between pixels and the offset value for compensation of the threshold voltage Vth with the data voltage Vdata, as expressed by the following Equation 9. It is possible to achieve data compensation by multiplying the data voltage Vdata by the gain value, and then adding the offset value to the value obtained by the multiplication.

$$V'data = \sqrt{\frac{k}{k'}} \times Vdata + Vth \quad \text{[Equation 9]}$$

$$\text{gain} = \sqrt{\frac{k}{k'}}$$

$$\text{offset} = Vth$$

Figure 9:
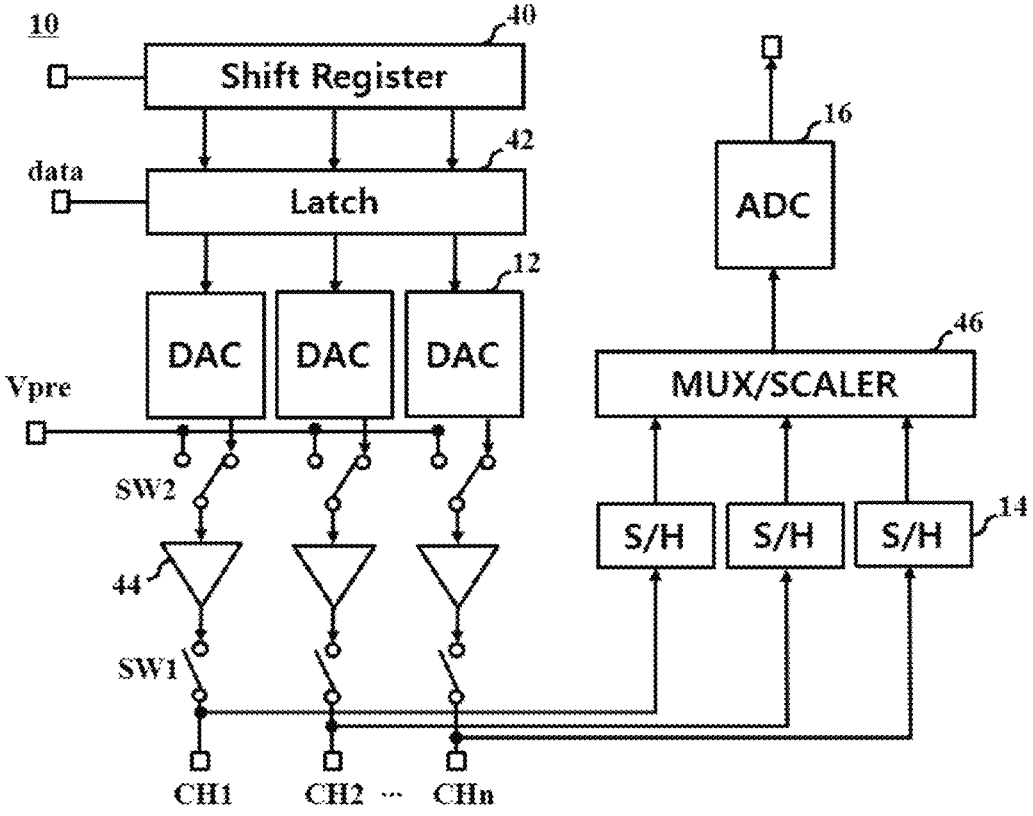
FIG. 9 is a circuit diagram illustrating a detailed configuration of a data driver according to an embodiment of the present invention.

FIG. 9 is a circuit diagram illustrating a detailed configuration of the data driver according to an embodiment of the present invention.

The data driver 10 shown in FIG. 9 includes a shift register 40, a latch 42, n DAC 12 respectively connected to a plurality of output channels CH1 to CHn, n sampling/holder (S/H) circuits 14 connected to respective output channels CH1 to CHn, and n output buffers 44 each connected between a corresponding one of the n DAC 12 and a corresponding one of the n output channels CH1 to CHn. The data driver 10 also includes n first switches SW1 each connected between a corresponding one of the n output buffers 44 and a corresponding one of the n output channels CH1 to CHn, n second switches SW2 each connected between a corresponding one of the n DAC 12 and a corresponding one of the n output buffers 44, and a multiplexer (MUX)/scaler 46 connected between the n S/H circuits 14 and the ADC 16.

The shift register 40 outputs sequential sampling signals in response to respective data shift clocks from the timing controller 30 shown in FIG. 1 in either the display mode or the sensing mode.

In response to the sequential sampling signals from the shift register 40, the latch 43 sequentially samples data from the timing controller 30 and latches the sampled data. When data for one horizontal line is latched, the latch 43 outputs the latched data to the n DAC 12 in a simultaneous manner.

Each of the n DAC 12 converts input data into a corresponding data voltage in either the display mode or the sensing mode, and supplies the data voltage to a corresponding one of the n output channels CH1 to CHn via a corresponding one of the n second switch SW2, a corresponding one of n output buffers 44, and a corresponding one of the n first switches SW1.

Each of the n second switches SW2 switches the pre-charge voltage Vpre supplied from outside during the pre-charging period in the sensing mode, and supplies the pre-charge voltage Vpre to a corresponding one of the n output channels CH1 to CHn via the corresponding output buffer 44 and corresponding first switch SW2. Meanwhile, the pre-charge voltage Vpre may be supplied from the timing controller 30 via the latch 42 and each DAC 12. In this case, the second switches SW2 to switch the pre-charge voltage Vpre may be dispensed with.

Each first switch SW1 is always turned on in the display mode. In the sensing mode, each first switch SW1 is turned on during a period, in which the pre-charge voltage Vpre and data voltage Vdata are supplied, while being turned off during a period in which the voltage of the corresponding data line DL supplied through a corresponding one of the output channels CH1 to CHn is measured.

In the sensing mode, each of the n S/H circuits 14 samples a measured voltage supplied through a corresponding one of the n data lines and a corresponding one of the n output channels CH1 to CHn, and holds the sampled voltage.

The MUX/scaler 46 sequentially selects the measured voltages output from the n S/H circuits 14, scales the selected voltages to match the driving voltage range of the ADC 16, and outputs the scaled voltages to the ADC 16. The MUX/scaler 46 may group the n measured voltages such that each group includes one or more measured voltages, to select the measured voltages by groups. This may be determined in various manners by the designer.

The ADC 16 converts a measured voltage from the MUX/scaler 46 into digital data, and supplies the digital data to the timing controller 30. Practically, one or more ADCs 16 may be provided to be equal in number to the number of output channels of the MUX/scaler 46 and, as such, the ADCs 16 may be connected to respective output channels of the MUX/scaler 46.

As apparent from the above description, in accordance with the method and apparatus for sensing characteristic parameters of pixel driving circuits in accordance with the present invention, it is possible to simply and rapidly measure the threshold voltage Vth and k-parameter of the driving TFT in each pixel driving circuit, through driving of the driving TFT by constant current. In accordance with the present invention, therefore, it is possible to measure the threshold voltage Vth and k-parameter of each pixel, not only during an inspection process, but also in a sensing mode intervening between successive display modes. Thus, it is also possible to measure variations of the threshold voltage Vth and k-parameter depending on passage of the use time of the AMOLED display device, and to compensate for the measured variations.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. An organic light emitting diode (OLED) display device comprising:

a display panel comprising a plurality of pixels each having a light emitting element and a pixel driving circuit for independently driving the light emitting element; and a characteristic parameter detecting unit for sensing characteristic parameters of the pixel driving circuit in each of the plural pixels, the characteristic parameter detecting unit driving the pixel driving circuit of one of the plurality of pixels as a sensing pixel, sensing a first voltage output from the pixel driving circuit of the sensing pixel in accordance with characteristics of a driving thin film transistor (TFT) in the pixel driving circuit of the sensing pixel and detecting a threshold voltage (Vth) of the driving TFT using the sensed first voltage, wherein the characteristic parameter detecting unit drives the pixel driving circuit of the sensing pixel using a data voltage compensated for the detected threshold voltage (Vth), senses a second voltage output from the pixel driving circuit of the sensing pixel responsive to driving the pixel driving circuit using the data voltage compensated for the detected threshold voltage (Vth), and detects a deviation of a process characteristic parameter (k-parameter) of the driving TFT using the sensed second voltage.

2. The display device according to claim 1, wherein the characteristic parameter detecting unit comprises:

a data driver for driving the data line, sensing the first voltage and the second voltage output from the pixel driving circuit on a line, and outputting the sensed first voltage and the sensed second voltage; and a timing controller for detecting the threshold voltage (Vth) and the deviation of the k-parameter based on the sensed first voltage and the sensed second voltage, respectively, from the data driver, calculating an offset value to compensate the detected threshold voltage (Vth) and a gain value to compensate for the detected k-parameter deviation, storing the calculated offset value and the calculated gain value, compensating input data by use of the stored offset value and the stored gain value, and supplying the compensated input data to the data driver.

3. The display device according to claim 2, wherein the timing controller detects the threshold voltage (Vth) by calculating a difference voltage between the sensed first voltage from the data driver and a reference voltage supplied to the pixel driving circuit of the sensing pixel.

4. The display device according to claim 3, wherein the timing controller detects the deviation of the k-parameter by detecting a variation in the voltage discharged in accordance with the characteristics of the driving TFT in the sensing pixel, based on the sensed second voltage from the data driver, and calculating a ratio of the detected voltage variation in the sensing pixel to a predetermined or previously-detected voltage variation in a reference one of the pixels.

5. The display device according to claim 2, wherein the pixel driving circuit comprises:

the driving TFT, which drives the light emitting element;

a first switching TFT for supplying the data voltage on the data line to a first node of the driving TFT in response to a first scan signal from a scan line;

a second switching TFT for supplying a reference voltage from a reference voltage line to a second node of the driving TFT in response to a second scan signal from the scan line; and a storage capacitor for charging a voltage between the first node and the second node, and supplying the charged voltage as a driving voltage for the driving TFT.

6. The display device according to claim 5, wherein:

the data driver supplies a pre-charge voltage to the data line, senses the voltage on the data line at a time when the driving TFT is driven in a saturated state in accordance with discharge of the pre-charge voltage from the data line through driving of the first and second switching TFTs, and outputs the sensed first voltage; and the timing controller detects the threshold voltage (Vth) by calculating a difference voltage between the sensed first voltage from the data driver and a reference voltage supplied to the pixel driving circuit of the sensing pixel.

7. The display device according to claim 6, wherein:

in a programming period, the data driver supplies, to the data line, a sum of the data voltage compensated for the detected threshold voltage (Vth) and the reference voltage, and the driving TFT is driven in accordance with the driving of the first and second switching TFTs;

in a pre-charging period following the programming period, the data driver pre-charges the data line with the pre-charge voltage, and the first and second switching TFTs are turned off;

in a discharging period following the pre-charging period, the data driver is disconnected from the data line, and the pre-charge voltage on the data line is discharged through the first switching TFT and the driving TFT;

at a sensing time following the discharging period, the first switching TFT is turned off, and the data driver senses the second voltage on the data line, and outputs the sensed second voltage; and the timing controller detects the k-parameter deviation by calculating a difference voltage between the pre-charge voltage and the second voltage sensed at the sensing time, to detect a voltage variation in the sensing pixel, and calculating a ratio of the voltage variation in the sensing pixel to a voltage variation in a reference one of the pixels.

8. The display device according to claim 5, wherein:

a first reference voltage is supplied to the reference voltage line, and the data driver supplies a pre-charge voltage to the data line, senses first voltages on the data line at a plurality of times when the driving TFT is driven in a saturated state in accordance with discharge of the pre-charge voltage from the data line through driving of the first and second switching TFTs, and outputs the first voltages as first sensed voltages;

a second reference voltage different from the first reference voltage is supplied to the reference voltage line, and the data driver supplies the pre-charge voltage to the data line, senses second voltages on the data line at the plurality of times when the driving TFT is driven in the saturated state in accordance with the discharge of the pre-charge voltage from the data line through the driving of the first and second switching TFTs, and outputs the second voltages as second sensed voltages; and the timing controller detects the threshold voltage (Vth) by detecting a time when a difference voltage between corresponding ones of the first and second sensed voltages output from the data driver is equal or similar to a difference voltage between the first and second reference voltages, and calculating a difference voltage between the first sensed voltage sensed at the detected time and the first reference voltage or a difference voltage between the second sensed voltage sensed at the detected time and the second reference voltage.

9. The display device according to claim 8, wherein:

in a programming period, the data driver supplies, to the data line, a sum of the data voltage compensated for the detected threshold voltage (Vth) and the reference voltage, and the driving TFT is driven in accordance with the driving of the first and second switching TFTs;

in a pre-charging period following the programming period, the data driver pre-charges the data line with the pre-charge voltage, and the first and second switching TFTs are turned off;

in a discharging period following the pre-charging period, the data driver is disconnected from the data line, and the pre-charge voltage on the data line is discharged through the first switching TFT and the driving TFT;

at a sensing time following the discharging period, the first switching TFT is turned off, and the data driver senses the second voltage on the data line, and outputs the sensed second voltage; and the timing controller detects the deviation of the k-parameter by calculating a difference voltage between the pre-charge voltage and the second voltage sensed at the sensing time, to detect a voltage variation in the sensing pixel, and calculating a ratio of the voltage variation in the sensing pixel to a voltage variation in a reference one of the pixels.

10. The display device according to claim 2, wherein the data driver comprises:

a plurality of digital-analog converters (DACs) for converting input data into analog data voltages by channels, respectively;

a plurality of sampling/holder circuits respectively connected to the data lines by channels, each of the sampling/holder circuits sampling a voltage on a corresponding one of the data lines, and holding and outputting the sampled voltage as the sensed voltage;

an analog-digital converter (ADC) for converting the sensed voltage from each of the sampling/holder circuits into digital data, and outputting the digital data; and a plurality of first switches connected between the DACs and the data lines by channels, respectively, to switch respective output voltages from the DACs.

11. The display device according to claim 10, wherein:

the data driver further comprises a multiplexer/scaler connected between the sampling/holder circuits and the ADC, the multiplexer/scaler selecting and scaling a plurality of sensed voltages from the sampling/holder circuits by groups, and outputting the scaled voltages to the ADC, each group including at least one sensed voltage; and the ADC are equal, in number, to output channels of the multiplexer/scaler.

12. The display device according to claim 11, wherein the data driver further comprises second switches supplying the pre-charge voltage to respective output channels of the DACs.

13. A method for sensing characteristic parameters of pixel driving circuits in an organic light emitting diode (OLED) display device including a plurality of pixels each including a light emitting element and a corresponding one of the pixel driving circuits to independently drive the light emitting element, comprising the steps of:

driving the pixel driving circuit of one of the plurality of pixels as a sensing pixel, sensing a first voltage output from the pixel driving circuit of the sensing pixel in accordance with characteristics of a driving thin film transistor (TFT) in the pixel driving circuit of the sensing pixel;

detecting a threshold voltage (Vth) of the driving TFT using the sensed first voltage;

driving the pixel driving circuit of the sensing pixel using a data voltage compensated for the detected threshold voltage (Vth);

sensing a second voltage output from the pixel driving circuit of the sensing pixel on the data line responsive to driving the pixel driving circuit using the data voltage compensated for the detected threshold voltage (Vth); and detecting a k-parameter deviation of the driving TFT based on the sensed second voltage.

14. The method according to claim 13, wherein detecting the threshold voltage (Vth) comprises calculating a difference voltage between the sensed first voltage and a reference voltage supplied to the pixel driving circuit of the sensing pixel, to detect the threshold voltage (Vth).

15. The method according to claim 14, wherein detecting the k-parameter variation comprises detecting a voltage variation in accordance with the characteristics of the driving TFT in the sensing pixel, based on the sensed second voltage, and calculating a ratio of the detected voltage variation in the sensing pixel to a predetermined or previously-detected voltage variation in a reference one of the pixels.

16. The method according to claim 15, wherein:

the pixel driving circuit comprises the driving TFT, which drives the light emitting element, a first switching TFT for supplying the data voltage on a data line to a first node of the driving TFT in response to a first scan signal from a scan line, a second switching TFT for supplying a reference voltage from a reference voltage line to a second node of the driving TFT in response to a second scan signal from the scan line, and a storage capacitor for charging a voltage between the first node and the second node, and supplying the charged voltage as a driving voltage for the driving TFT; and wherein detecting the threshold voltage (Vth) comprises:

supplying a pre-charge voltage to the data line, and then sensing the first voltage on the data line at a time when the driving TFT is driven in a saturated state in accordance with discharge of the pre-charge voltage from the data line through driving of the first and second switching TFTs; and calculating a difference voltage between the sensed first voltage and the reference voltage, to detect the threshold voltage (Vth).

17. The method according to claim 16, wherein detecting the k-parameter deviation comprises:

supplying, in a programming period, a sum of a data voltage compensated for the detected threshold voltage (Vth) and the reference voltage to the data line, and driving the driving TFT in accordance with the driving of the first and second switching TFTs;

pre-charging, in a pre-charging period following the programming period, the data line with the pre-charge voltage, and turning off the first and second switching TFTs;

floating the data line in a discharging period following the pre-charging period, and discharging the pre-charge voltage on the data line through the first switching TFT and the driving TFT;

turning off the first switching TFT at a sensing time, which corresponds to the sensing time or each of the sensing times and follows the discharging period, and sensing the second voltage on the data line;

calculating a difference voltage between the pre-charge voltage and the second voltage sensed at the sensing time, to detect a voltage variation in the sensing pixel; and calculating a ratio of the voltage variation in the sensing pixel to a voltage variation in a reference one of the pixels, to detect the k-parameter deviation.

18. The method according to claim 15, wherein:

the pixel driving circuit comprises the driving TFT, which drives the light emitting element, a first switching TFT for supplying the voltage on a data line to a first node of the driving TFT in response to a first scan signal from a scan line, a second switching TFT for supplying a reference voltage from a reference voltage line to a second node of the driving TFT in response to a second scan signal from the scan line, and a storage capacitor for charging a voltage between the first node and the second node, and supplying the charged voltage as a driving voltage for the driving TFT; and wherein detecting the threshold voltage (Vth) comprises:

supplying a first reference voltage to the reference voltage line, supplying a pre-charge voltage to the data line, sensing first voltages on the data line at a plurality of times when the driving TFT is driven in a saturated state in accordance with discharge of the pre-charge voltage from the data line through driving of the first and second switching TFTs, and outputting the first voltages as first sensed voltages;

supplying a second reference voltage different from the first reference voltage to the reference voltage line, supplying the pre-charge voltage to the data line, sensing second voltages on the data line at the plurality of times when the driving TFT is driven in the saturated state in accordance with the discharge of the pre-charge voltage from the data line through the driving of the first and second switching TFTs, and outputting the second voltages as second sensed voltages; and detecting a time when a difference voltage between corresponding ones of the first and second sensed voltages output from the data driver is equal or similar to a difference voltage between the first and second reference voltages, and calculating a difference voltage between the first sensed voltage sensed at the detected time and the first reference voltage or a difference voltage between the second sensed voltage sensed at the detected time and the second reference voltage, to detect the threshold voltage (Vth).

19. The method according to claim 18, wherein detecting the k-parameter deviation comprises:

supplying, in a programming period, a sum of the data voltage compensated for the detected threshold voltage (Vth) and the reference voltage to the data line, and driving the driving TFT in accordance with the driving of the first and second switching TFTs;

pre-charging, in a pre-charging period following the programming period, the data line with the pre-charge voltage, and turning off the first and second switching TFTs;

floating the data line in a discharging period following the pre-charging period, and discharging the pre-charge voltage on the data line through the first switching TFT and the driving TFT;

turning off the first switching TFT at a sensing time, which follows the discharging period, and sensing the second voltage on the data line;

calculating a difference voltage between the pre-charge voltage and the second voltage sensed at the sensing time, to detect a voltage variation in the sensing pixel; and calculating a ratio of the voltage variation in the sensing pixel to a voltage variation in a reference one of the pixels, to detect the k-parameter deviation.

* * * * *